US010153551B1

(12) United States Patent
Hong et al.

(10) Patent No.: US 10,153,551 B1
(45) Date of Patent: Dec. 11, 2018

(54) LOW PROFILE MULTI-BAND ANTENNAS FOR TELEMATICS APPLICATIONS

(71) Applicants: Yang-Ki Hong, Tuscaloosa, AL (US); Woncheol Lee, Tuscaloosa, AL (US); Jaejin Lee, Tuscaloosa, AL (US)

(72) Inventors: Yang-Ki Hong, Tuscaloosa, AL (US); Woncheol Lee, Tuscaloosa, AL (US); Jaejin Lee, Tuscaloosa, AL (US)

(73) Assignee: The Board of Trustees of the University of Alabama for and on behalf of the University of Alabama, Tuscaloosa, AL (US)

( * ) Notice: Subject to any disclaimer, the term of this patent is extended or adjusted under 35 U.S.C. 154(b) by 331 days.

(21) Appl. No.: 14/807,689

(22) Filed: Jul. 23, 2015

Related U.S. Application Data

(60) Provisional application No. 62/028,099, filed on Jul. 23, 2014.

(51) Int. Cl.
*H01Q 5/10* (2015.01)
*H01Q 5/307* (2015.01)

(52) U.S. Cl.
CPC ..... *H01Q 5/307* (2015.01); *H01Q 5/10* (2015.01)

(58) Field of Classification Search
CPC ..... H01Q 5/307; H01Q 5/10; H01Q 9/0414
USPC ..... 343/749
See application file for complete search history.

(56) References Cited

U.S. PATENT DOCUMENTS 6,061,025 A * 5/2000 Jackson ..... H01Q 1/38 343/700 MS
7,436,363 B1 * 10/2008 Klein ..... H01Q 5/00 343/700 MS
2008/0055178 A1 * 3/2008 Kim ..... H01Q 1/38 343/787
2009/0102723 A1 * 4/2009 Mateychuk ..... H01Q 5/40 343/700 MS
2009/0295662 A1 * 12/2009 Suetsuna ..... H01Q 1/48 343/787
2010/0231482 A1 * 9/2010 Yoshida ..... G06K 19/07749 343/904
2012/0038526 A1 2/2012 Baek et al.
2014/0085158 A1 * 3/2014 Wong ..... H01Q 1/48 343/841

(Continued)

OTHER PUBLICATIONS

Moon, et al., "An extremely low-profile ferrite-loaded wideband VHF antenna design," IEEE Antennas Wirel. Propag. Lett., vol. 11, 2012.

(Continued)

*Primary Examiner* — Dameon E Levi
*Assistant Examiner* — David Lotter
(74) *Attorney, Agent, or Firm* — Maynard Cooper & Gale, P.C.; Jon E. Holland

(57) ABSTRACT

A low-profile multi-band antenna for telematics applications is described, where the antenna has multiple resonant frequencies. A single feed connects multiple transceivers to the antenna. The antenna has a height less than a centimeter and a surface area of around 60 square centimeters. The resonant frequencies of the antenna are determined by a center sub-patch and additional sub-patches that surround the center sub-patch. Ferrites, placed between the sub-patches and a ground plane, are used for tuning the resonant frequencies.

26 Claims, 7 Drawing Sheets

(56) References Cited

U.S. PATENT DOCUMENTS

2015/0340765 A1* 11/2015 Dang ..... H01Q 21/0075
343/893
2016/0013561 A1* 1/2016 Hong ..... H01Q 1/243
343/787

OTHER PUBLICATIONS

Lau, et al., "A monopolar patch antenna with very wide impedance bandwidth," IEEE Trans. Antennas Propag., vol. 53, 2005.
Lau, et al., "A wide-band monopolar wire-patch antenna for indoor base station applications," IEEE Antennas Wirel. Propag. Lett., vol. 4, 2005.
Zheng, et al., "A wide band low-profile monopolar patch antenna," Microw. Opt. Technol. Lett., vol. 53, 2011.
Baek, et al., "Low-profile planar roof-mounted vehicle antenna for monopole vertical polarization reception," Microw. Opt. Technol. Lett., vol. 54, 2012.
Row, et al., "Monopolar square patch antennas with wideband operation," Electron. Lett., vol. 30, 2006.
Hong, et al., "Low-Profile, Multi-Element, Miniaturized Monopole Antenna," IEEE Trans. Antennas Propag. vol. 57, 2009.
Daniel Frederic Sievenpiper, "High-Impedance Electromagnetic Surfaces," University of California, p. 1-162, 1999.
Liu, et al., A Novel Broad Beamwidth Conformal Antenna on Unmanned Aerial Vehicle, IEEE Antennas Wirel. Propag. Lett., vol. 11, 2012.
Callaghan, et al., "Dual-Band Pin-Patch Antenna for Wi-Fi Applications," IEEE Antennas Wirel. Propag. Lett., vol. 4, 2008.

* cited by examiner

Frequency Bands for Automotive Wireless Communications

| Frequency Bands | Applications | Frequency range (Mhz) | |
|---|---|---|---|
| VHF | FM broadcasting radio | 87.5-108 | |
| VHF & UHF | Terrestrial digital video broadcasting | 110-270<br>350-870 | |
| UHF | GSM 850/900 | 824-894 / 880-960 | 970 |
| L | GSM 1800/ PCS1900 | 1710-1880 /1850-1990 | 980 |
| L & S | UMTS | 1920-2170 | |
| UHF, L & S | 4G LTE | 746-787 / 704-746 / 1710-1880 / 1710-2155 / 1920-2170 | |
| L | GPS | 1574-1576 | |
| S | XM satellite radio | 2332.5-2345 | |
| S & C | Wireless LAN (WLAN) | 2400-2483<br>5150-5250 | 990 |
| C | Dedicated short-range communication (DSRC) | 5850-5925 | |
| Ku | Direct Broadcasting Satellite (DBS) TV | 12200-12700 | |
| K | Short-range radar | 22000-26000 | |
| W | Long-range radar | 76000-77000 | |

*FIG. 10*

LOW PROFILE MULTI-BAND ANTENNAS FOR TELEMATICS APPLICATIONS

CROSS-REFERENCE TO RELATED APPLICATION

This application claims priority to U.S. Provisional Application No. 62/028,099, entitled "Low Profile Multi-Band Antennas for Telemetric Applications," and filed on Jul. 23, 2014, which is incorporated herein by reference.

BACKGROUND

Advanced automotive telematics and multimedia applications often require a separate antenna for each of a plurality of telecommunication devices. In order to reduce the number of antennas required within a system, such as an automobile, it is generally desirable for an antenna operate efficiently over multiple frequency bands. Further, it is desirable for an automotive antenna to have a low maintenance cost and to have a configuration conducive to facilitate integration with a vehicle's body so as not degrade vehicle aerodynamics or impede the creative design of the vehicle body. In addition, antennas for telematics applications preferably have an omnidirectional radiation pattern with vertical polarization in order to transmit and receive signals in all directions from widely distributed mobile base stations.

In order to meet the above desired characteristics, a variety of antennas have been considered. Such antennas include monopole, dipole, helix, loop, patch, and planar inverted F, and wire-patch antennas. These antennas have a large height and/or need to be placed far from a conductive surface of the automobile. Further, these antennas are often difficult to integrate with the structure of the automobile. Often reflections from a conductive surface of the automobile cause destructive interference with the signals communicated by these antennas thereby decreasing antenna gain.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 10 is a table showing frequency bands that are often used for automotive telematics.

DETAILED DESCRIPTION

The present disclosure generally pertains to antennas having structures desirable for automotive telematics. In one exemplary embodiment, an antenna has a structure dimensioned and shaped so as not to significantly impede or limit an automobile's looks, shape, or aerodynamic characteristics. Such antenna may be less than a centimeter thick and forms a rectangular shape having a width of about 70 millimeters (mm) and length of about 80 mm, although other dimensions are possible. The antenna can be integrated into or otherwise situated on the automobile during manufacturing, or the antenna can be mounted on the top of or otherwise situated on the automobile at a later time.

The antenna comprises a patch of conducting material that is a distance above and parallel to a ground plane. The patch comprises a first sub-patch, referred to herein as "center sub-patch" of conducting material surrounded by at least a second sub-patch of conducting material. The first sub-patch is separated from the second sub-patch by a peripheral gap, which may be filled with an insulator, if desired. In addition, the first sub-patch is connected to the second sub-patch by one or more connecting lines. If desired, there may be other sub-patches that surround the first and second sub-patches.

Regardless of the number, the plurality of sub-patches form a centric arrangement of sub-patches where each outer sub-patch surrounds and is conductively coupled to an inner sub-patch. Further, each of the sub-patches is coupled to the ground plane by shorting pins of conducting material. The sub-patches, connecting lines, shorting pins, and ground plane form an antenna having a plurality of resonant frequencies (e.g., one resonant frequency for each sub-patch), thereby enabling the antenna to efficiently transmit and receive signals in multiple frequency bands.

Figure 1:
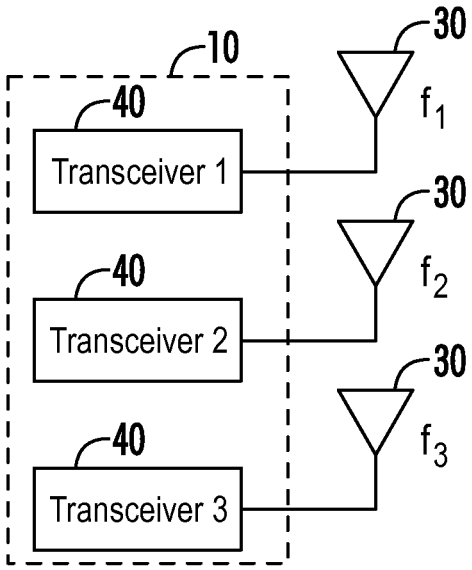
FIG. 1 (PRIOR ART)
FIG. 1 depicts multiple transceivers of a vehicle respectively coupled to multiple antennas in a conventional arrangement.

FIG. 1 depicts a conventional arrangement of three transceivers 40 that are located inside a vehicle 10, such as an automobile. A first transceiver 40 transmits and receives communication signals within a first band of frequencies for transferring information to and from the vehicle 10. A first antenna 30 is conductively coupled to the first transceiver 40 for wirelessly transmitting communication signals from the first transceiver 40 and for receiving wireless signals to be processed by the first transceiver 40. The first antenna 30 is mounted on an outside surface of the vehicle 10 and is configured to radiate and receive electromagnetic signals having energy in the first band of frequencies. The first antenna 30 has a first resonant frequency, $f_1$, which is approximately equal to the center frequency of the first band of frequencies. Similarly, a second transceiver 40 and a third transceiver 40 are coupled respectively to a second antenna 30 having a second resonant frequency, $f_2$, and a third antenna 30 having a third resonant frequency, $f_3$. Because each antenna 30 is configured to radiate electromagnetic signals at a band of frequencies corresponding to the antenna's respective transceiver, the antenna 30 for one transceiver cannot effectively radiate at the band of frequencies of either of the other transceivers. Each of the antennas 30 is typically positioned and mounted on an outside surface of the vehicle 10. The use of multiple antennas can be problematic since vehicle 10 has a limited amount of outside surfaces suitable for mounting antennas.

Figure 2:
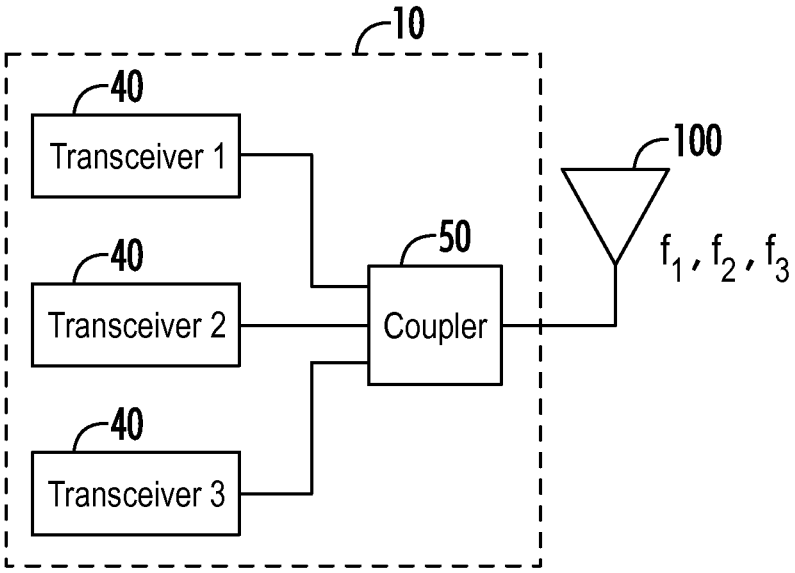
FIG. 2 depicts multiple transceivers of a vehicle coupled to a single antenna according to an exemplary embodiment of the present disclosure.

FIG. 2 depicts an automobile communication system having a single antenna 100 that services multiple transceivers 40, although it is possible for the system to have multiple antennas 100 in other embodiments. Antenna 100 is connected via coupler 50 to each of three transceivers 40, although the antenna 100 may be coupled to other numbers of transceivers 40 in other embodiments. In one exemplary embodiment, each transceiver 40 communicates in a different frequency range, and the antenna has multiple resonant frequencies: one for each respective transceiver frequency range. In the exemplary embodiment shown by FIG. 2, the antenna 100 has three resonant frequencies and can efficiently radiate and receive electromagnetic signals having energy at or near the three resonant frequencies, although other numbers of frequency ranges are possible in other embodiments. Specifically, the antenna 100 is configured for transmitting and receiving the respective band of frequencies of the first transceiver 40, the second transceiver 40, and the third transceiver 40. Hence, antenna 100 may function as a replacement for the three conventional antennas 30 of FIG. 1. Note that the antenna 100 may occupy about the same amount of vehicle outside surface typically occupied by one of the antennas of FIG. 1. Further, as will be seen, antenna 100 of the present disclosure has a low profile so that it can be integrated into the vehicle's structure or mounted on the vehicle 10 during manufacturing or at a later time.

Figure 3:
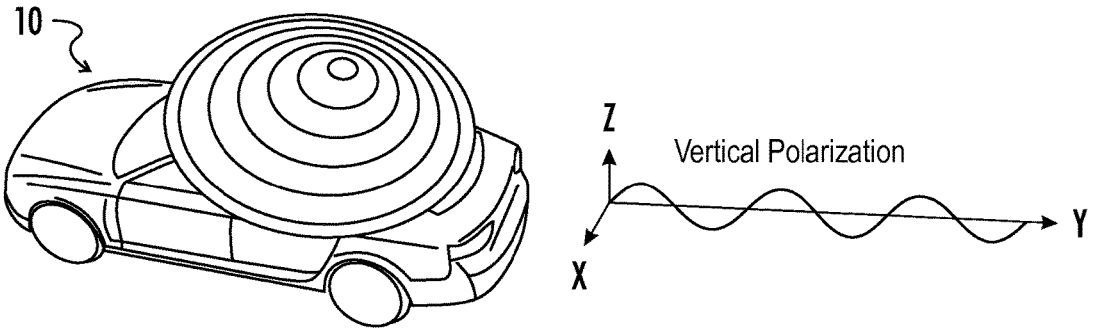
FIG. 3 depicts an automobile with an antenna having an omnidirectional radiation pattern with vertical polarization.

FIG. 3 depicts an ideal three dimensional radiation pattern of an antenna mounted on a top surface of an automobile 10. Upon receiving a communication signal from a transceiver in the automobile, the antenna transmits electromagnetic energy consistent with frequencies of the communication signal and the radiation pattern of the antenna. In general, an antenna configured to transmit a band of frequencies can also receive electromagnetic signals in that same band of frequencies. For automotive and other communication system applications, transmit and receive electromagnetic signals of an antenna have vertical polarization so that reliable wireless communication can be established with widely distributed base stations. The antenna 100 has a low profile so it can be incorporated into the shape of the automobile's body without having a significant impact on the aerodynamics or appearance of the automobile.

Figure 4:
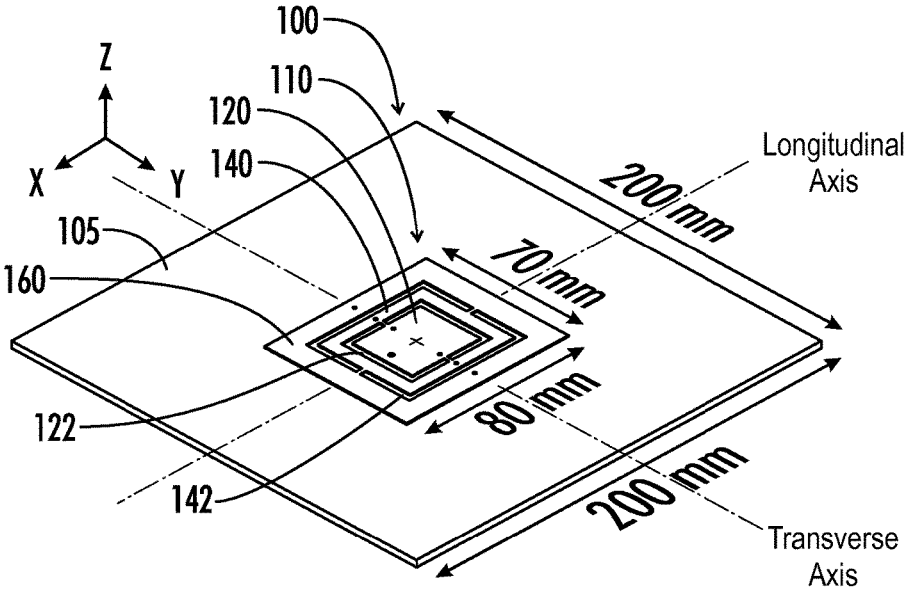
FIG. 4 depicts an exemplary embodiment of an antenna in accordance with the present disclosure.

FIG. 4 depicts an embodiment of an antenna 100 in accordance with the present disclosure. The antenna 100 comprises a patch 110 of conducting material that is formed on and extends above a ground plane 105 by about 6 mm (millimeters), although other dimensions are possible in other embodiments. The conducting material of patch 110 may be formed on and supported by a substrate. The substrate may partially or fully extend between the bottom of patch 110 and the ground plane 105. Those skilled in the art may use other fabrication techniques to ensure that the antenna 100 has structural and electrical integrity.

Figure 5:
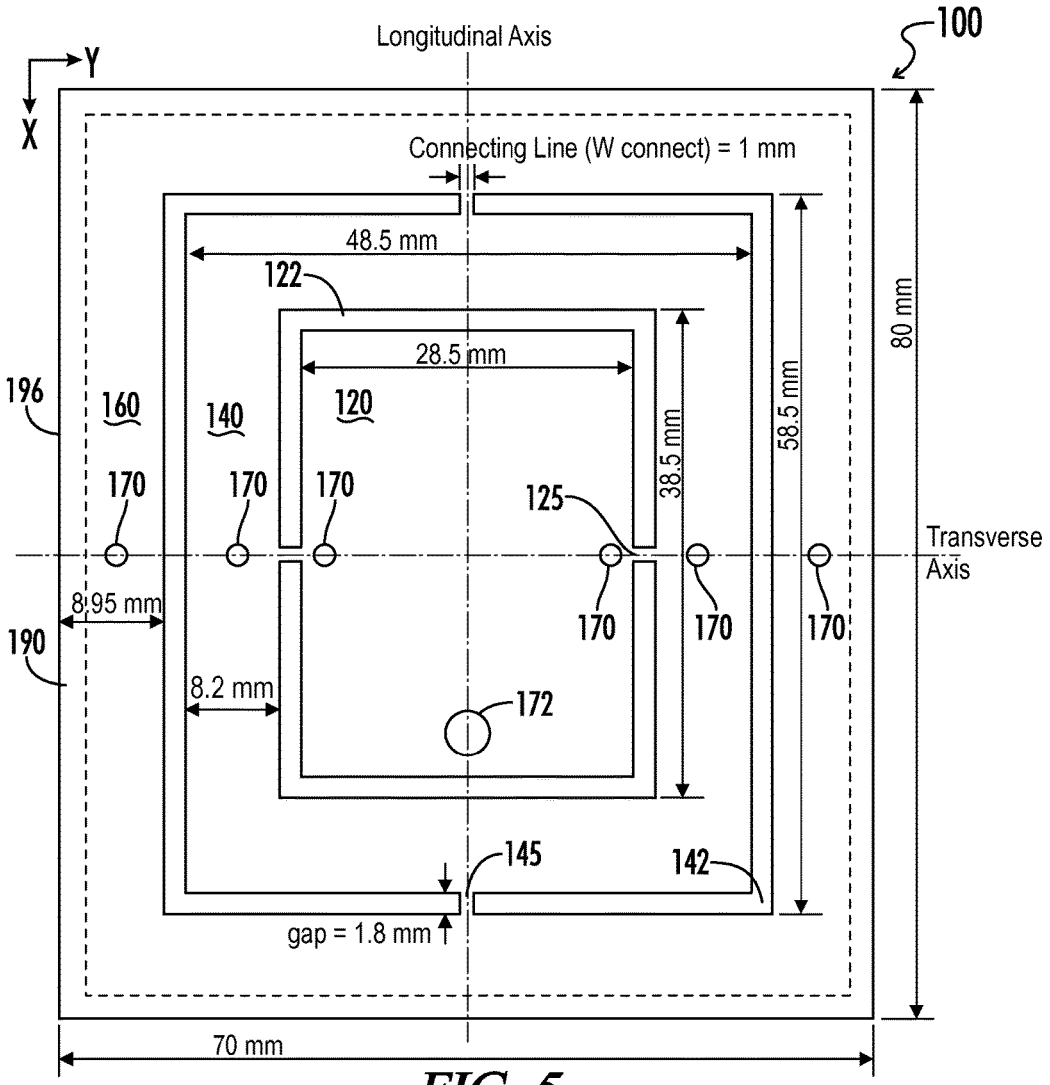
FIG. 5 depicts a top view of the antenna depicted by FIG. 4.

The ground plane 105 has a square shape with each side having a length of about 200 mm. In other embodiments, the ground plane 105 may have other shapes and dimensions. It is possible that a conducting surface of an automobile, such as an outer surface of a roof, hood, trunk, or side panel, can serve as the ground plane 105 for the antenna 100. The patch 110 has a rectangular shape with a long side of about 80 mm and a short side of about 70 mm, though other sizes and shapes are possible. The patch 110 comprises a center sub-patch 120, a middle sub-patch 140, and an outer sub-patch 160. Each sub-patch is made of conducting material and has a rectangular shape, although other shapes are possible. Further, each sub-patch is separated from an adjacent sub-patch by a gap that extends around the periphery of the inner sub-patch. As depicted in FIG. 4, a gap 122 extends around the periphery of center sub-patch 120, and gap 142 extends around the periphery of the middle sub-patch 140. For antenna 100 of FIG. 4, each gap has a width of around 1.8 mm. Other gap widths are possible in other embodiments. The gap 122 is defined by an outside edge of center sub-patch 120 and an inside edge of middle sub-patch 140. The gap 142 is defined by an outside edge of middle sub-patch 140 and an inside edge of outer sub-patch 160. As depicted in FIG. 4 and FIG. 5, the sub-patches are symmetrical about a longitudinal axis and a transverse axis. The gap may be open (e.g., filled with air) or may be partially or fully filled with an insulator.

FIG. 5 depicts a top view of the antenna 100 depicted by FIG. 4. The top view more clearly illustrates the configuration of the sub-patches and gaps. Center sub-patch 120 of the antenna 100 is surrounded by gap 122 that extends about the periphery of the center sub-patch. The gap 122 has a width of about 1.8 mm. The outside edge of the center sub-patch 120 defines the inner edge of the gap 122, and the inner edge of the middle sub-patch 140 defines the outer edge of gap 122. The distance between the outer edge of the middle sub-patch 140 and the inner edge of the middle sub-patch 140 is about 8.2 mm. That distance can be referred to as the width of the middle sub-patch 140. The middle sub-patch 140 of the antenna 100 is surrounded by a gap 142 that extends about the periphery of the middle sub-patch 140. The gap 142 has a width of about 1.8 mm. The outside edge of the middle sub-patch 140 defines the inner edge of the gap 142, and the inner edge of the outer sub-patch 160 defines the outer edge of the gap 142. The distance between the outer edge of the outer sub-patch 160 and the inner edge of the outer sub-patch 160 is about 8.95 mm. That distance is referred to as the width of the outer sub-patch 160. In other embodiments, other gap dimensions are possible.

FIG. 5 provides additional details for the antenna 100 of FIG. 4 depicting conductors that provide connections between sub-patches. Although the sub-patches are separated by gaps as described above, two connecting lines 125, i.e., strips of conducting material, conductively couple a portion of the outside edge center sub-patch 120 to a portion of the inside edge of middle sub-patch 140. As shown in FIG. 5 connecting lines 125 are aligned with the transverse axis of antenna 100. In addition, two connecting lines 145 of conducting material conductively couple a portion of the outside edge of the middle sub-patch 140 to a portion of the inside edge of outer sub-patch 160. Connecting lines 145 are aligned with the longitudinal axis of antenna 100. In one exemplary embodiment, each connecting line is a narrow strip of conducting material having a width of around 1.0 mm. Other widths for connecting lines are possible in other embodiments. In addition, other locations, types and numbers of connecting lines are possible in other embodiments.

The arrangement shown by FIG. 5, in which a patch antenna has multiple sub-patches surrounding each other, as described, provides multiple resonant frequencies for the antenna 100. In this regard, a first resonant frequency is dependent on all the sub-patches. A second resonant frequency is attributed to middle sub-patch 120 and the center sub-patch 140, and a third resonant frequency is attributed to the center sub-patch 120.

Figure 6:
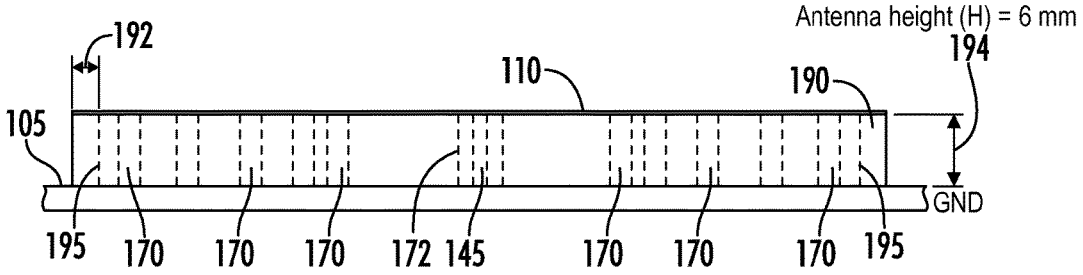
FIG. 6 depicts a side view of the antenna depicted by FIG. 5.

Two shorting pins 170 of conducting material, shown in FIG. 5 and FIG. 6, conductively couple the ground plane 105 to each sub-patch. As indicated above, the shorting pins are positioned along the transverse axis of antenna 100. In one embodiment shorting pin 170 has a radius of around 0.2 mm. In other embodiments shorting pin 170 has other radii or shapes. One end of each shorting pin 170 makes electrical contact with ground plane 105, and another end of each shorting pin makes electrical contact with a bottom surface of a respective sub-patch. There is one pair of shorting pins 170 for each sub-patch. In other embodiments, other numbers of shorting pins 170 per sub-patch are possible.

As depicted in FIG. 6, there are shorting pins 170 coupling each of the sub-patches 120, 140, 160 to the ground plane 105. The shorting pins 170 are positioned along the transverse axis of patch 110 and make electrical contact with a portion of the bottom surfaces of each sub-patch and with the ground plane 105. Two shorting pins 170 couple each of the sub-patches to the ground plane 105. The shorting pins 170 have a radius of about 0.2 mm and a length of about 6 mm. Other dimensions for the shorting pins are possible in other embodiments of antenna 100. When the antenna 100 is radiating, the shorting pins 170 generate strong vertical surface current, thereby providing monopole antenna characteristics of omnidirectional radiation and vertical polarization. A signal feed connector 172 having a radius of about 0.5 mm is positioned near the bottom portion the center sub-patch 120 along the longitudinal axis of the antenna. One end of feed connector 172 makes electrical contact with the ground plane and another end of the feed connector makes electrical contact with a bottom surface of center sub-patch 120. Other locations, shapes, and dimensions for the feed connector are possible.

In order to reduce antenna size and improve antenna gain, ferrite material is positioned between a bottom surface of the patch 110 and ground plane 105. In one embodiment, a ferrite 190 has a rectangular shape with an outside dimension, a width, and a height. The outside dimension of ferrite 190 corresponds to and is approximately equal to the dimension of the outside edge of the outer sub-patch 160. The ferrite's height 194 is about 6 mm, and its width 192 can have values between about 2 mm and about 6 mm, although other dimensions are possible. Ferrite 190 serves as a tuning element to adjust the resonant frequencies, alternately called the radiation frequencies, of antenna 100. Ferrite 190 as depicted in the top view of FIG. 5 has an outside surface 196 with a rectangular shape. The ferrite 190 has an inside surface 195, depicted in FIG. 6, located at width 192 from the outside surface 196 of the ferrite. Since ferrite material generally possesses a relative permeability and a relative permittivity greater than unity, ferrite 190 decreases antenna size for a given frequency and improves impedance matching. In other embodiments other ferrite material properties are possible, such as, for example, a ferrite material with an anisotropy field greater than 1.5 kOe. One such material having a high anisotropy field is hexagonal ferrite.

Figure 7:
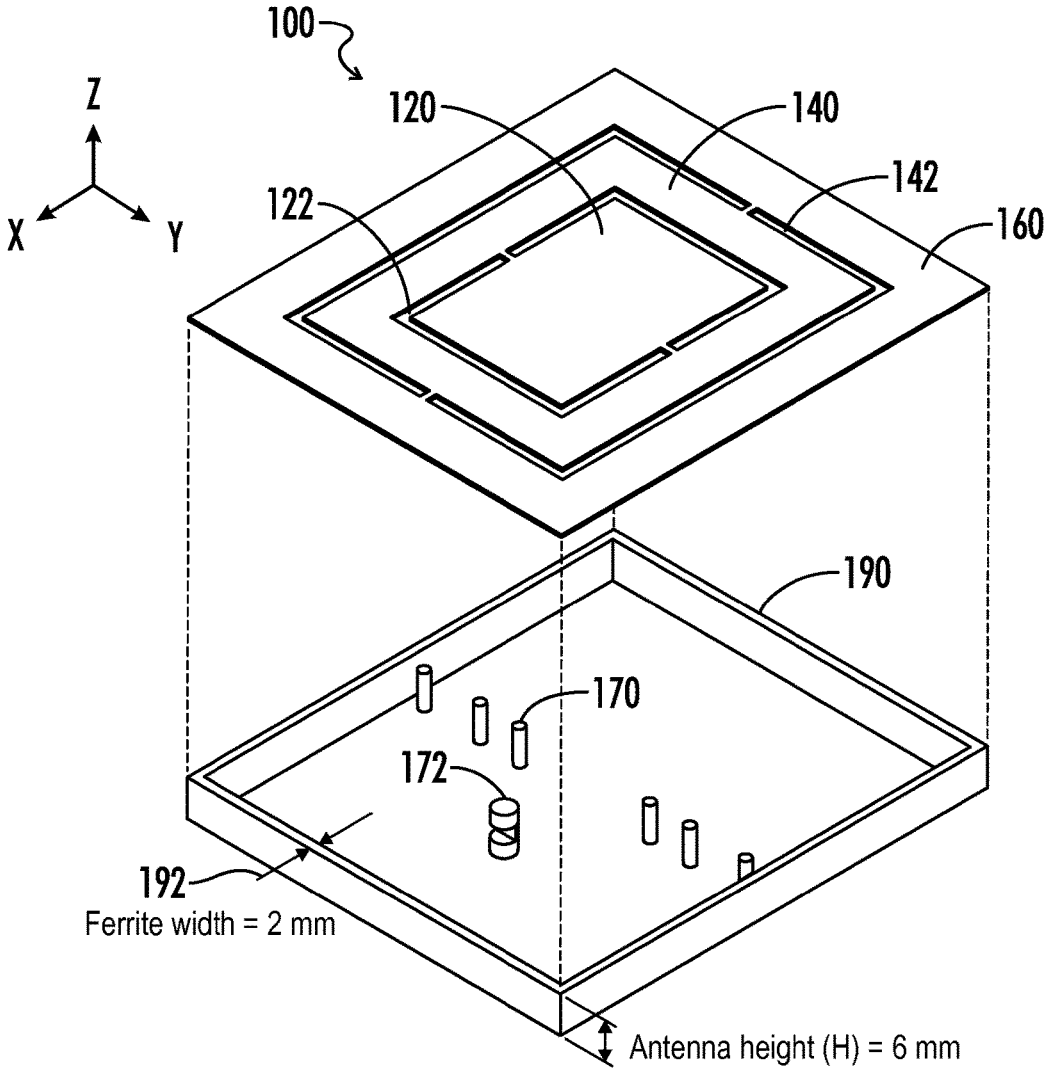
FIG. 7 depicts an expanded view of the antenna of FIG. 4 illustrating the relative locations of antenna elements.

FIG. 7 is an expanded perspective view of antenna 100 of FIG. 5. Patch 110 as depicted comprises 3 sub-patches separated by gaps. Center sub-patch 120 is enclosed by middle sub-patch 140 and middle sub-patch 140 is enclosed by sub-patch 160. Center sub-patch 120 has a rectangular shape and both the middle sub-patch 140 and the outer sub-patch 160 have rectangular shapes. Although the sub-patches are separated by gaps they are also coupled together by connecting lines as shown in FIG. 7. When the patch 110 is moved in the minus z-direction, the patch 110 makes contact with ferrite 190, shorting pins 170 and connector 172.

Antenna 100 has three resonant frequencies or frequencies that efficiently radiate and receive electromagnetic energy containing the three frequencies. Hence, antenna 100 functions as three separate conventional antennas. However, antenna 100 can be mounted on around one third of the surface area needed by three separate conventional antennas. The height of the antenna 100 may be less than a centimeter and its footprint may be about 70 mm by 80 mm, though other antenna dimensions are possible in other embodiments. The antenna 100 has features that make it desirable for use on an automobile having a variety of telecommunication requirements.

Figure 8:
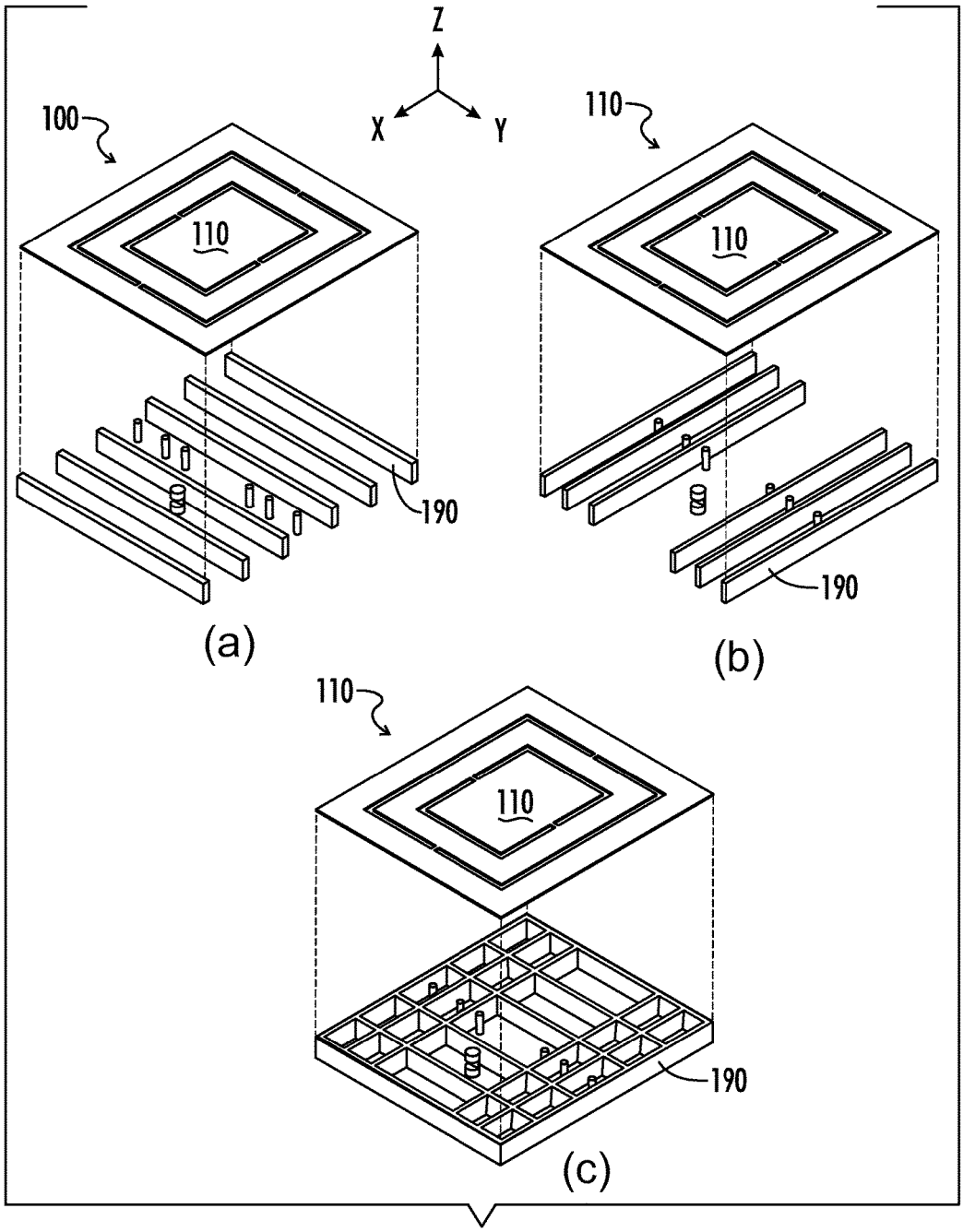
FIG. 8 depicts an exemplary embodiment of an antenna of the present disclosure having an arrangement of ferrites different than the antenna depicted by FIG. 7.

FIG. 8 depicts an embodiment of an antenna 100 having multiple ferrites located between the ground plane 105 and patch 110. The ferrites as shown comprise a set of strips of ferrite material extending in the y-direction and another set of ferrites extending the x-direction, wherein the sets of ferrites form a grid of ferrites. Each of the ferrites as shown has a width of around 2 mm and a height of about 6 mm. In other embodiments, other arrangements of ferrites are possible. In general, when the amount of ferrite material is increased, the size of the antenna decreases for a desired radiation frequency.

Figure 9:
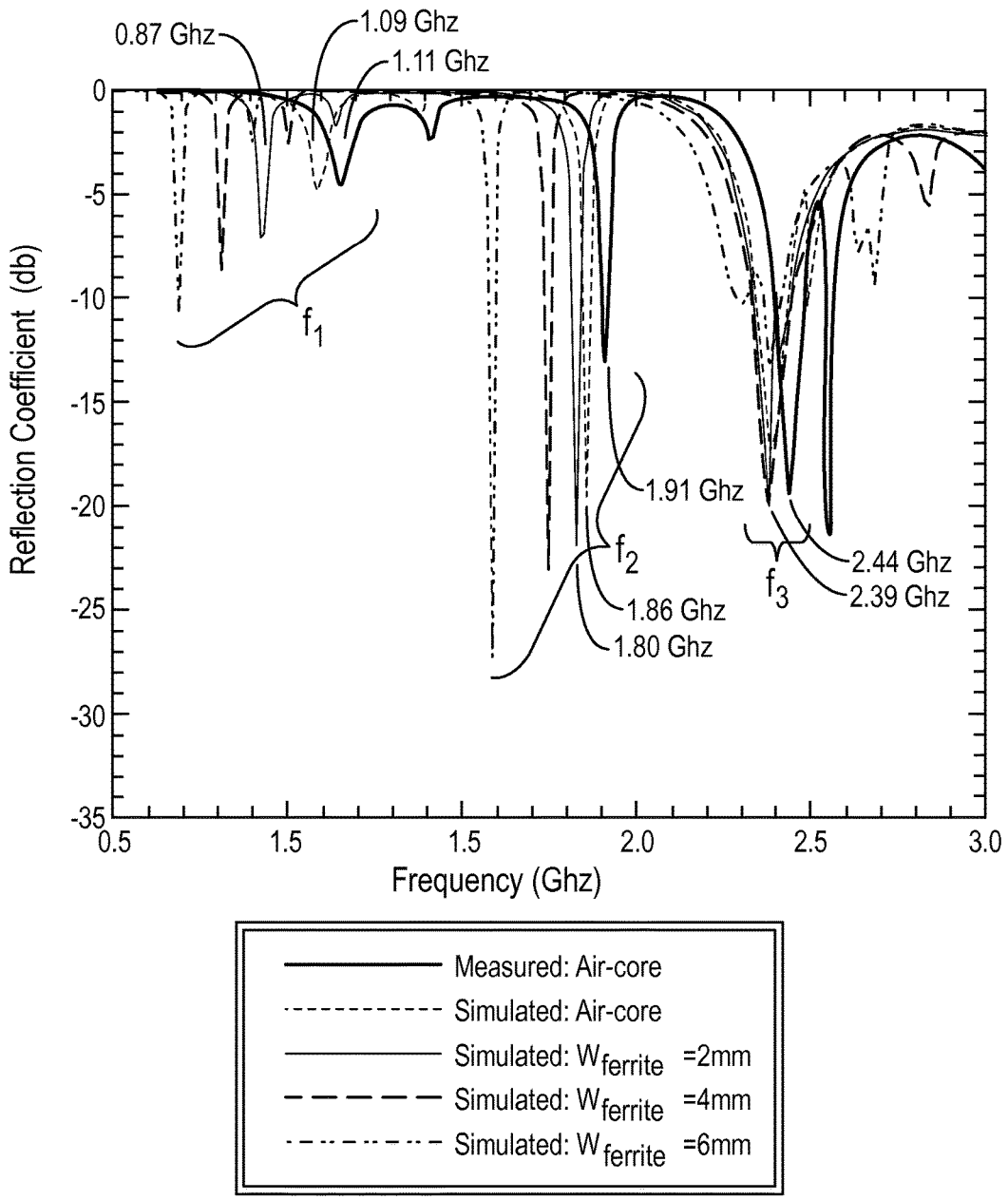
FIG. 9 depicts frequency shifts in antenna characteristics as the width of a ferrite is varied for the antenna of FIG. 4.

FIG. 9 depicts simulated and measured resonant frequencies of antenna 100 without a ferrite. The simulated resonant frequencies are 1.09, 1.86, and 2.39 GHz, and the measured resonant frequencies are 1.14, 1.91, and 2.45 GHz. The measured result is in close agreement with the simulated result. Also, resonant frequencies of antenna 100 change as ferrite width changes as shown in FIG. 9. As shown, an increase in ferrite width decreases resonant frequencies, $f_1$ and $f_2$. However, resonant frequency $f_3$ does not change with changes in ferrite width. For example, $f_1$ is 1.09 GHz when antenna 100 has an air core and is reduced to about 0.87 GHz when the antenna has a ferrite 190 with a width 192 of about 2 mm. Second frequency, $f_2$, changes from an air core value of about 1.86 GHz to about 1.80 GHz when ferrite 190 has a width 192 of about 2 mm. The third resonant frequency, $f_3$, remains at its air core frequency of about 2.39 GHz when ferrite 190 is added.

FIG. 10 shows frequencies associated with telematics services that may be desired for an automobile application. The resonant frequencies for antenna 100 as shown in FIG. 9 have values suitable for the desired communication frequencies. An automobile occupant may want to use a cell phone operating as a GSM 850 device, table location 970, which requires frequencies in the 824-894 MHz range. Frequency $f_1$ is suitable for this range of radiation frequencies. Further, an occupant may wish to use a cell phone based on GSM 1800, table location 980, and need frequencies from 1.770 to 1.880 GHz. Frequency $f_2$ is suitable for this range of radiation frequencies. In addition, the user may wish to use a wireless LAN (WLAN), table location 990, having frequencies in the 2.4 to 2.483 GHz range. Frequency $f_3$ has a range of radiation frequencies suitable for the WLAN range of radiation frequencies.

The embodiments of antenna 100 as depicted above are merely examples and are not limitations on the scope of the present disclosure. Other dimensions and shapes of elements are possible in other embodiment. As an example, in various embodiments described above, a patch antenna 100 is shown as having three sub-patches, but the antenna 100 may have any number of sub-patches in other embodiments.

Now, therefore, the following is claimed:

1. An antenna for telematics comprising:

a first sub-patch of conducting material;

a second sub-patch of conducting material surrounding the first sub-patch and separated from the first sub-patch by a gap, wherein the second sub-patch is conductively coupled to the first sub-patch;

a ground plane, wherein the first and second sub-patches are located at a distance above the ground plane; and a plurality of shorting pins for conductively coupling the ground plane to the first and second sub-patches, the plurality of shorting pins comprising a first pair of shorting pins and a second pair of shorting pins, wherein the antenna has a first resonant frequency based on the second sub-patch and the second pair of shorting pins, and wherein the antenna has a second resonant frequency based on the second sub-patch, the first sub-patch, and the first pair of shorting pins.

2. The antenna of claim 1, wherein a ferrite extends between the ground plane and a bottom surface of the second sub-patch, and wherein the ferrite has a width and a path corresponding to an outer perimeter of the second sub-patch.

3. The antenna of claim 2, wherein the ferrite has an anisotropy field of at least 1.5 kOe.

4. The antenna of claim 1, wherein the distance between the first and second sub-patches and the ground plane is less than one centimeter.

5. The antenna of claim 1, wherein the first sub-patch and the second sub-patch have a rectangular shape.

6. The antenna of claim 5, wherein a ferrite extends between the ground plane and a bottom surface of the second sub-patch, and wherein the ferrite has a width and a path corresponding to an outer perimeter of the second sub-patch.

7. The antenna of claim 6, wherein one or more ferrite strips extend between bottom surfaces of the sub-patches and the ground plane and the one or more ferrite strips are parallel to a side of the ferrite.

8. The antenna of claim 1, wherein the first resonant frequency is in a range between 0.7 and 1.1 GHz and the second resonant frequency is in a range between 1.6 and 1.7 GHz.

9. An antenna for telematics comprising:

a first sub-patch of conducting material;

a second sub-patch of conducting material surrounding the first sub-patch and separated from the first sub-patch by a gap, wherein the second sub-patch is conductively coupled to the first sub-patch;

a third sub-patch of conducting material surrounding the second sub-patch and separated from the second sub-patch by a gap, wherein the third sub-patch is conductively coupled to the second sub-patch;

a ground plane, wherein the first, second and third sub-patches are located at a distance above the ground plane; and a plurality of shorting pins for conductively coupling the ground plane to the first, second and third sub-patches, wherein the antenna has three resonant frequencies and each resonant frequency is based on at least one sub-patch.

10. The antenna of claim 9, wherein the plurality of shorting pins comprises a first pair of shorting pins, a second pair of shorting pins, and a third pair of shorting pins, the antenna has a first resonant frequency based on the third sub-patch and the third pair of shorting pins, the antenna has a second resonant frequency based on the second sub-patch, the third sub-patch, and the second pair of shorting pins, and the antenna has a third resonant frequency based on the first sub-patch, the second sub-patch, the third sub-patch, and the first pair of shorting pins.

11. An antenna for telematics comprising:

a substrate having a first sub-patch of conducting material and a second sub-patch of conducting material disposed on a surface of the substrate, wherein the second sub-patch surrounds the first sub-patch and is separated from the first sub-patch by a gap, and wherein the second sub-patch is conductively coupled to the first sub-patch;

a ground plane located at a distance from the surface of the substrate; and a plurality of shorting pins for conductively coupling the ground plane to the first and second sub-patches, the plurality of shorting pins comprising a first pair of shorting pins and a second pair of shorting pins, wherein the antenna has a first resonant frequency based on the second sub-patch and the second pair of shorting pins, and wherein the antenna has a second resonant frequency based on the second sub-patch, the first sub-patch, and the first pair of shorting pins.

12. The antenna of claim 11, wherein the first sub-patch and the second sub-patch have a rectangular shape.

13. The antenna of claim 11, wherein a ferrite extends between the ground plane and a bottom surface of the second sub-patch, and wherein the ferrite has a width and has a path corresponding to an outer perimeter of the second sub-patch.

14. The antenna of claim 13, wherein the ferrite has an anisotropy field of at least 1.5 kOe.

15. The antenna of claim 13, wherein the ferrite has a relative permeability greater than one and a relative permittivity greater than one.

16. The antenna of claim 13, wherein one or more ferrite strips extend between a bottom surface of one of the sub-patches and the ground plane.

17. The antenna of claim 11, wherein the first sub-patch and the second sub-patch have a rectangular shape.

18. The antenna of claim 17, wherein a ferrite extends between the ground plane and a bottom surface of the second sub-patch, and wherein the ferrite has a width and a path corresponding to an outer perimeter of the second sub-patch.

19. The antenna of claim 18, wherein one or more ferrite strips extends between bottom surfaces of the sub-patches and the ground plane and the one or more ferrite strips are parallel to a side of the ferrite.

20. The antenna of claim 11, wherein the antenna has a third sub-patch of conducting material disposed on the surface of the substrate, wherein the third sub-patch surrounds the second sub-patch and is separated from the second sub-patch by a gap, and wherein the third sub-patch is conductively coupled to the second sub-patch, and wherein the first resonant frequency is in a range between 0.7 and 1.1 GHz, the second resonant frequency is in a range between 1.6 and 1.9 GHz, and a third resonant frequency is in a range between 2.3 and 2.5 GHz.

21. The antenna of claim 11, wherein the plurality of shorting pins are configured to generate vertical surface current to provide vertical polarization for the first and second resonant frequencies.

22. The antenna of claim 11, wherein the plurality of shorting pins comprise a first pair of shorting pins conductively coupling the first sub-patch and the ground plane and a second pair of shorting pins conductively coupling the second sub-patch and the ground plane.

23. The antenna of claim 1, wherein the plurality of shorting pins are configured to generate vertical surface current to provide vertical polarization for the first and second resonant frequencies.

24. The antenna of claim 1, wherein the plurality of shorting pins comprise a first pair of shorting pins conductively coupling the first sub-patch and the ground plane and a second pair of shorting pins conductively coupling the second sub-patch and the ground plane.

25. The antenna of claim 9, wherein the plurality of shorting pins are configured to generate vertical surface current to provide vertical polarization for the three resonant frequencies.

26. The antenna of claim 9, wherein the plurality of shorting pins comprise a first pair of shorting pins conductively coupling the first sub-patch and the ground plane, a second pair of shorting pins conductively coupling the second sub-patch and the ground plane, a third pair of shorting pins conductively coupling the third sub-patch and the ground plane.

* * * * *